US012704040B2

(12) United States Patent
Nguyen et al.

(10) Patent No.: US 12,704,040 B2
(45) Date of Patent: Aug. 11, 2026

(54) DOWNHOLE TOOL, METHOD, AND SYSTEM

(71) Applicant: Baker Hughes Oilfield Operations LLC, Houston, TX (US)

(72) Inventors: Tuan Nguyen, Pearland, TX (US); James Scott Trahan, Magnolia, TX (US); Morten Eidem, Trondheim (NO); Gaute Grindhaug, Hafrsfjord (NO)

(73) Assignee: Baker Hughes Oilfield Operations LLC, Houston, TX (US)

( * ) Notice: Subject to any disclaimer, the term of this patent is extended or adjusted under 35 U.S.C. 154(b) by 24 days.

(21) Appl. No.: 18/775,147

(22) Filed: Jul. 17, 2024

(65) Prior Publication Data

US 2026/0022616 A1 Jan. 22, 2026

(51) Int. Cl.
*E21B 33/12* (2006.01)
*E21B 17/05* (2006.01)
*E21B 33/129* (2006.01)

(52) U.S. Cl.
CPC ..... *E21B 33/1208* (2013.01); *E21B 17/05* (2013.01); *E21B 33/129* (2013.01)

(58) Field of Classification Search
CPC .... E21B 33/1208; E21B 17/05; E21B 33/129; E21B 33/1291
See application file for complete search history.

(56) References Cited

U.S. PATENT DOCUMENTS

| | | | | | |
|---|---|---|---|---|---|
| 2,224,826 | A * | 12/1940 | Mackowski | E21B 33/129 | 166/241.1 |
| 2,694,549 | A * | 11/1954 | James | E21B 17/05 | 175/323 |
| 5,413,180 | A * | 5/1995 | Ross | E21B 33/1295 | 166/239 |
| 5,915,474 | A | 6/1999 | Buytaert et al. | | |
| 6,019,173 | A | 2/2000 | Saurer et al. | | |
| 2002/0070018 | A1 | 6/2002 | Buyaert | | |
| 2011/0277998 | A1 | 11/2011 | Mcgarian | | |
| 2019/0003258 | A1 | 1/2019 | Klam et al. | | |
| 2021/0071496 | A1* | 3/2021 | Brown | E21B 33/128 | |
| 2021/0277741 | A1* | 9/2021 | Xue | E21B 33/134 | |

OTHER PUBLICATIONS

Notification of Transmittal of the International Search Report and the Written Opinion of the International Searching Authority, ISA/KR; PCT/US2025/037802; Mail date: Nov. 12, 2025; 9 pages.

* cited by examiner

*Primary Examiner* — Yong-Suk (Philip) Ro
(74) *Attorney, Agent, or Firm* — Baker Hughes Company

(57) ABSTRACT

A borehole tool, including a first section having a seal and a seal anchor, a second section attached to the first section by a joint having at least two degrees of freedom. A method for positioning and setting a downhole tool, including running a tool to a target location, setting the seal anchor, setting the seal packer, and positioning the second section by manipulating the joint. A wellbore system including a borehole in a subsurface formation, a string in the borehole, and a downhole tool, disposed within or as a part of the string.

18 Claims, 9 Drawing Sheets

DOWNHOLE TOOL, METHOD, AND SYSTEM

BACKGROUND

In the resource recovery and fluid sequestration industries reduction of runs and increases in adaptability are desirable to improve efficiency and reduce costs. Tools that provide capabilities resulting in benefits of this regard are well received by the art.

SUMMARY

An embodiment of a borehole tool, including a first section having a seal and a seal anchor, a second section attached to the first section by a joint having at least two degrees of freedom.

An embodiment of a method for positioning and setting a downhole tool, including running a tool to a target location, setting the seal anchor, setting the seal packer, and positioning the second section by manipulating the joint.

An embodiment of a wellbore system including a borehole in a subsurface formation, a string in the borehole, and a downhole tool, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
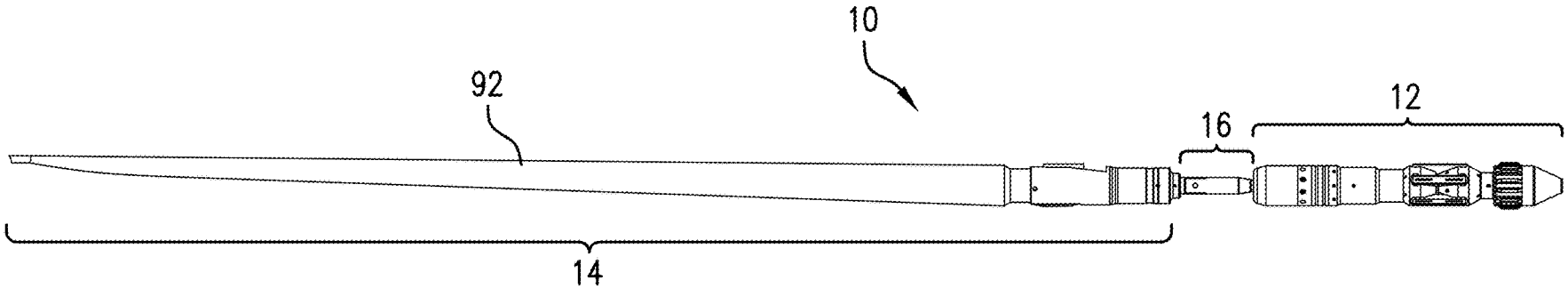
FIG. 1 is a side view of a downhole tool as described herein.
Figure 2:
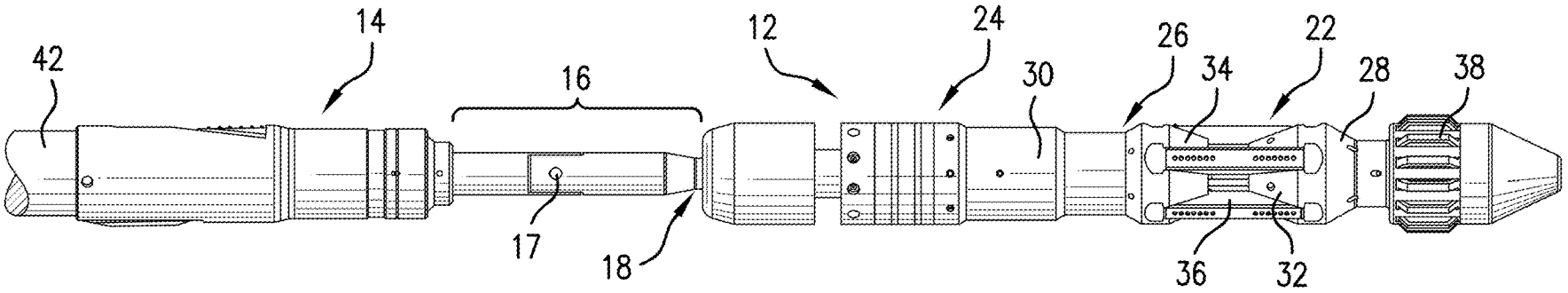
FIG. 2 is an enlarged view of a portion of FIG. 1.
Figure 3:
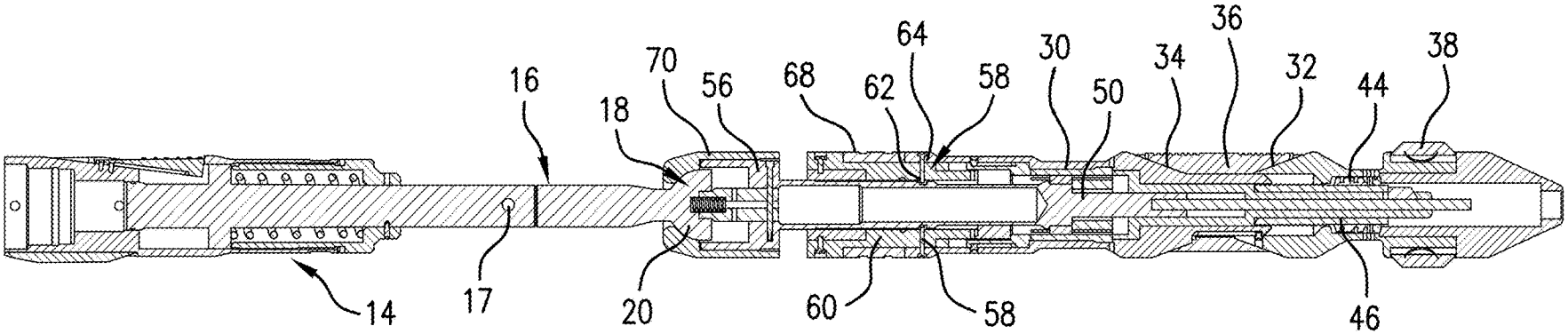
FIGS. 3-7 are sectional views of the view of FIG. 2 with the tool in different operational positions.

Referring to FIGS. 1-3, an embodiment of a downhole tool 10 is illustrated in side view to provide an overall understanding. The tool 10 in this embodiment includes a first section 12 and a second section 14 that are operably connected to one another by a segment 16 that provides at least two degrees of freedom in a joint 18 (see FIG. 3) configured within the segment 16 or configured between the segment 16 and the first section 12 or the second section 14. In an embodiment, the joint 18 is a swivel joint where a ball 20 is disposed upon the segment 16 and a ball socket is disposed in the first section 12 or the second section 14. As illustrated the socket is in the first section. The joint 18 allows for flexibility for things such as a whipstock to be rotated for orientation and then flexed to set back against an opposing side of the borehole all while the first section 12 is anchored and sealed in place. This arrangement facilitates the setting of the first section 12 and a second section 14 in a single trip whether the first and second sections remain connected to one another or are separated at a release 17 and then spaced from one another, for example by separating the second section at the releaser from the first section and moving the second section uphole prior to setting the second section by for example hydraulic pressure. No hydraulic connection to surface via dedicated line or via annulus or tubing ID (inside diameter) is required to set the first section 12. Overall, the tool 10 as disclosed herein vastly improves the efficiency and reduces cost in multilateral operations.

Figure 4:
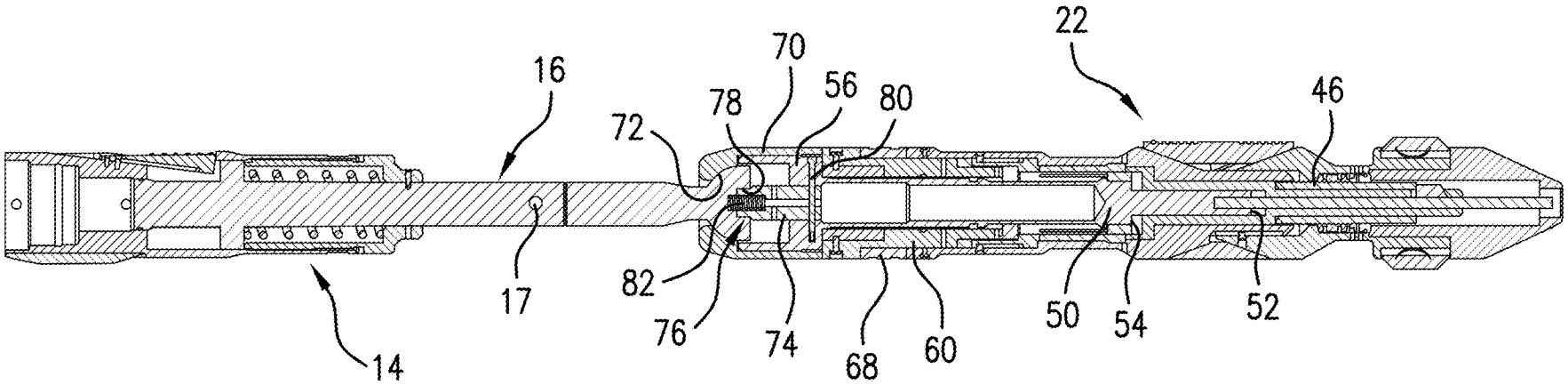
Figure 5:
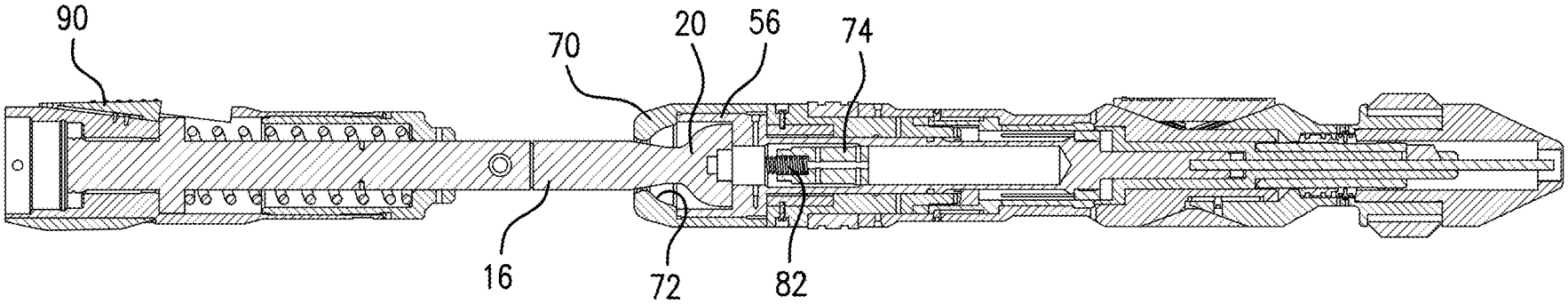

Referring to FIGS. 3-6, the first section 12 comprises a seal anchor 22 and a seal 24 that operate as a location fixer and a pressure barrier. The seal anchor 22 further comprises a housing 26 having a first part 28 that moves relative to a second part 30. First part 28 includes a frustoconical surface 32 and second part 30 includes a frustoconical surface 34, with surfaces 32 and 34 facing in opposite directions. Movement of the first part 28 relative to the second part 30 brings them closer together. As they get closer together a slip 36 will be forced radially outwardly as it climbs both frustoconical surfaces simultaneously. In the illustrated embodiment the movement of the first part 28 and second part 30 is rotationally based. The first part 28 includes a drag block 38 that is proud of a surface 40 of the housing 26 and is dimensioned and configured to drag against in inside surface of a tubular casing or an open hole (not shown). The drag block 38 slows rotational movement of the first part 28 relative to a rotational movement of the tool 10 pursuant to string 42 rotation from surface or other location such as more locally via motor or similar. Specifically, in an embodiment, rotation from surface rotates the first section 12 but due to drag block 38, the first part 28 tends to rotate more slowly. The differential rotation rate between first part 28 and second part 30 is harnessed to cause an expandable nut 44 to threadably move along a lead screw 46 to pull the first part 28 and the second part 30 toward one another, thereby forcing the slip 36 radially outwardly. A final set position may be obtained through this rotation in some embodiments but in other embodiments, final set is achieved through set down weight where the slip 36 is forced further outwardly through axial loading into the second frustoconical surface 34 (pursuant to set down weight, for example). The difference in FIGS. 3 and 4 provide additional understanding of the seal anchor 22. The set down weight that occurs between FIGS. 3 and 4 both sets seal anchor 22 and activates the seal 24 for setting.

Once the seal anchor 22 is set, the seal 24 may be set by set down weight against the seal anchor 22. Focusing on FIGS. 3 and 4, more components of the first section 12 are described. The second part 30 of the housing 26 houses a mandrel 50 extending from joint 18 to an end 52 in proximity with lead screw 46 and having load shoulder 54. Mandrel 50 includes a joint housing 56 that in a run in position is spaced from second part 30 of housing 26. The spacing is maintained by a release mechanism 58 such as a shear screw, collet configuration, etc. In the illustrated embodiment, there is also an element compression sleeve 60 radially outwardly of the mandrel 50 and radially inwardly disposed of the housing 26. The same release mechanism 58 may maintain the sleeve 60 in place relative to the housing 26, where the mechanism has dual release thresholds. For example, in a shear screw embodiment, the diameter of the shear screw may be different in diameter, material, stress riser, or otherwise at an interface 62 between the sleeve 60 and the mandrel 50 and at a second interface 64 between the sleeve 60 and the housing 26. This allows a first threshold load in set down weight to be required to shift the mandrel 50 relative to the sleeve 60 in order to hard set the slip 36 and then a second threshold to be required to shift the sleeve 60 relative to the housing 26 in order to compress an element 68 that produces seal 24.

Nested with the joint housing 56 is a joint seat housing 70 that supports a joint seat 72 complementarily shaped to secure the ball 20 for joint mobility having at least two degrees of freedom. Because during setting of the seal anchor 22, rotation from the string 42 must be transmitted to the first part 28, there is provided a drive sub 74 that includes a ball engagement end 76 having a cross sectional geometric shape of a non-circle such that torque may be transmitted (such as a square, triangle, oval, star shape, etc.). A complementary recess 78 is found in the ball 20 to receive the end 76. The drive sub also includes a rotation lock release member 80 such as a shear member that renders the drive sub 74 rotationally locked to the mandrel 50. During the weight set down operation to set the element 68, the member 80 is loaded and released. A biaser 82 is disposed to help separate the drive sub 74 from the ball 20 as is illustrated in the difference between FIGS. 5 and 6.

Figure 6:
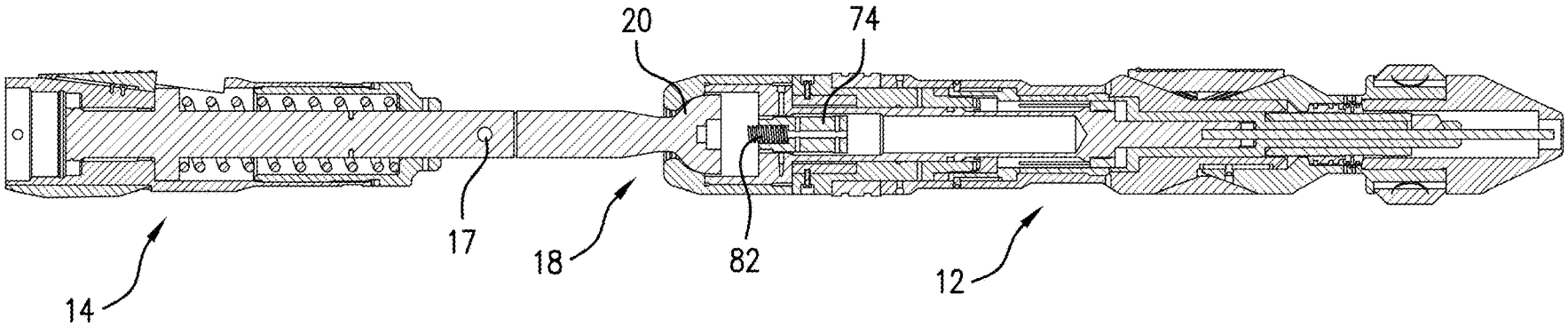
Figure 8A:
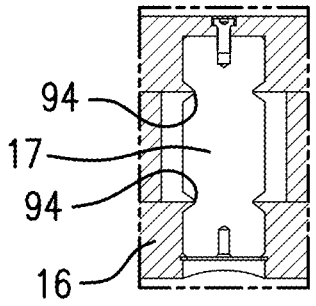
FIGS. 8A and 8B are alternate releasers for the downhole tool.

Continuing reference to FIG. 6, the ball 20 is reset in joint seat 72 by overpull on string 42, whereafter, at least two degrees of freedom are provided through the joint 18 for the second section 14 of the tool 10. As illustrated the second section 14 is a whipstock tool having a whip anchor 90 and a diverter 92 but it is to be understood that other tools might be substituted for second section 14. The whipstock tool illustrated particularly benefits from the at least two degrees of freedom afforded by the tool 10 because the diverter 92 (see FIG. 1) may be azimuthally oriented and the back of the whipstock may be nestled against the back wall for support when the yet to come kick off of another string (such as a drill string) is initiated. The release 17 may be configured with various ratings for separation using different dimensions, different materials or stress risers 94 (see FIG. 8A).

Figure 7:
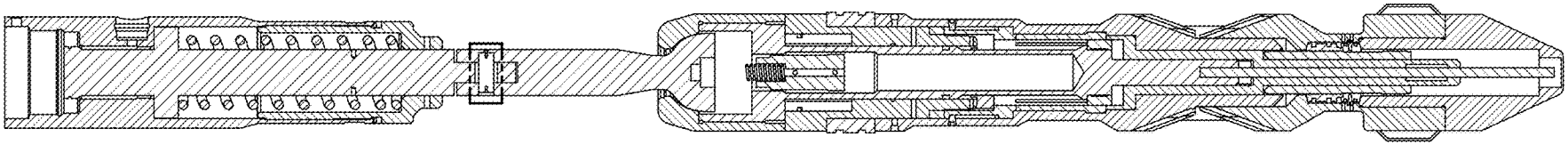
Figure 8B:
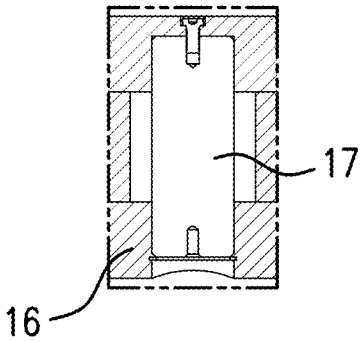

Referring to FIGS. 7-8B, it is to be appreciated is that the segment 16 may be separated at the release 17 (as mentioned above).

Figure 9:
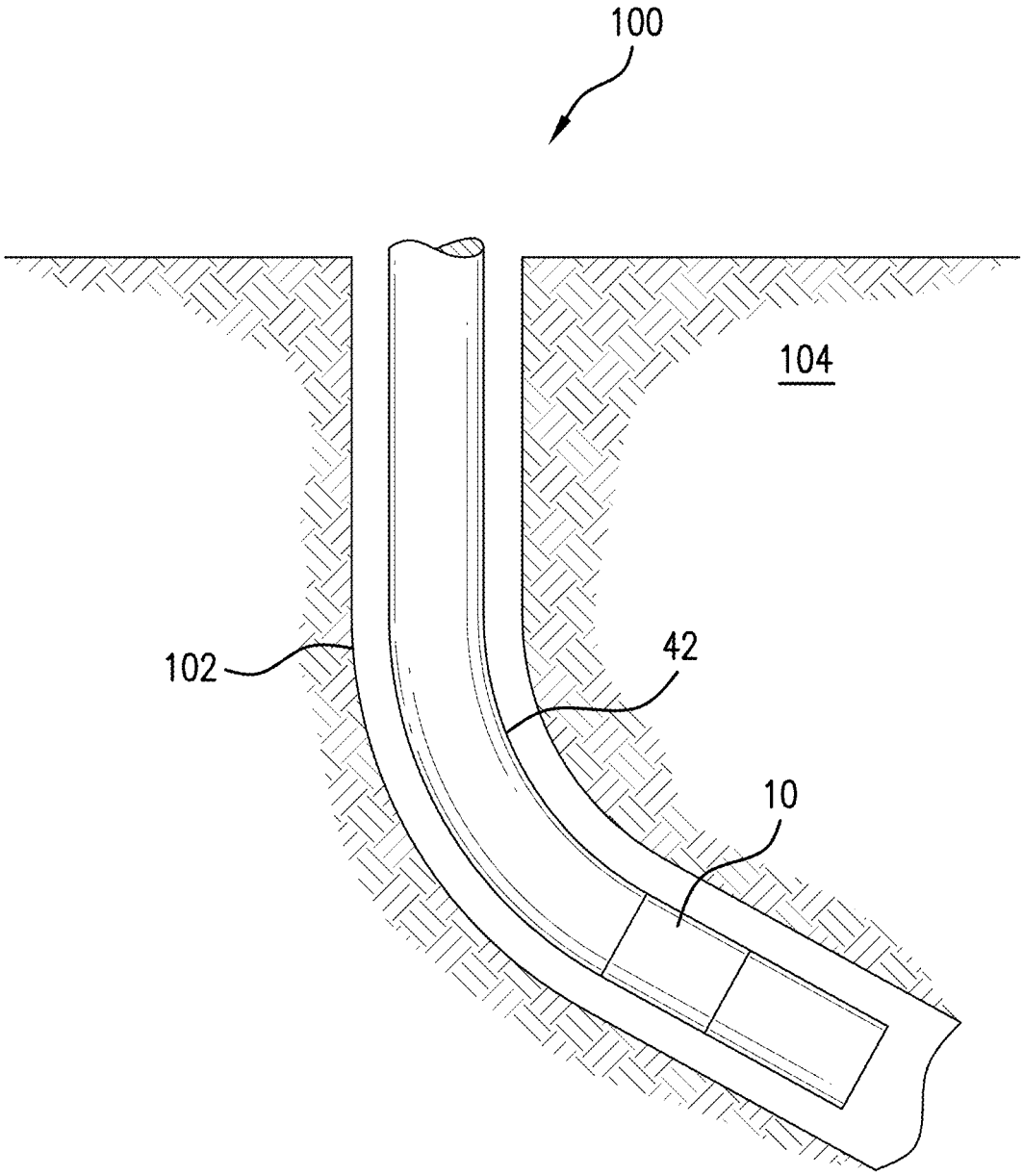
FIG. 9 is a view of a wellbore system including a downhole tool as disclosed herein.

Referring to FIG. 9, a wellbore system 100 is illustrated. The system 100 comprises a borehole 102 in a subsurface formation 104. A string 42 is disposed within the borehole 102. A borehole tool 10 as disclosed herein is disposed within or as a part of the string 42.

Set forth below are some embodiments of the foregoing disclosure:

Embodiment 1: A borehole tool, including a first section having a seal and a seal anchor, a second section attached to the first section by a joint having at least two degrees of freedom.

Embodiment 2: The tool as in any prior embodiment, wherein the joint is a swivel joint.

Embodiment 3: The tool as in any prior embodiment, wherein the swivel joint comprises a ball.

Embodiment 4: The tool as in any prior embodiment, wherein the seal anchor includes a rotary ratchet.

Embodiment 5: The tool as in any prior embodiment, wherein the rotary ratchet includes a threaded rod and an expandable nut.

Embodiment 6: The tool as in any prior embodiment, wherein the seal anchor includes a drag block.

Embodiment 7: The tool as in any prior embodiment, wherein the first section comprises a housing having a first part that is movable relative to a second part, the first part exhibiting a first frustoconical surface and the second part exhibiting an oppositely directed second frustoconical surface, the first part and the second part becoming shorter upon setting of the seal anchor.

Embodiment 8: The tool as in any prior embodiment, wherein the seal anchor includes a slip cooperative with the first and second frustoconical surfaces.

Embodiment 9: The tool as in any prior embodiment, wherein a segment extends between the first section and the second section.

Embodiment 10: The tool as in any prior embodiment, wherein the segment is separable at a location along a span thereof at a releaser.

Embodiment 11: The tool as in any prior embodiment, wherein the releaser is a pin.

Embodiment 12: The tool as in any prior embodiment, wherein the second section is settable independent of the first section and settable before or after separation of the segment at the releaser.

Embodiment 13: A method for positioning and setting a downhole tool, including running a tool as in any prior embodiment to a target location, setting the seal anchor, setting the seal packer, and positioning the second section by manipulating the joint.

Embodiment 14: The method as in any prior embodiment, wherein setting the seal anchor comprises rotating the tool while dragging a block of the tool thereby creating relative rotational movement between a first part of a housing of the first section and a second part of the housing of the first section.

Embodiment 15: The method as in any prior embodiment, wherein setting the seal comprises setting down weight on the seal anchor.

Embodiment 16: The method as in any prior embodiment, further comprising activating the joint with the set down weight.

Embodiment 17: The method as in any prior embodiment, further including moving the second section relative to the first section at the joint.

Embodiment 18: The method as in any prior embodiment, wherein the moving includes at least two degrees of freedom.

Embodiment 19: The method as in any prior embodiment, including separating the second section from the first section after setting the seal anchor.

Embodiment 20: A wellbore system including a borehole in a subsurface formation, a string in the borehole, and a downhole tool as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A borehole tool, comprising:

a first section having a seal and a seal anchor;

a second section attached to the first section by a ball joint having at least two degrees of freedom, the ball joint including a ball; and a drive sub in the first section configured to drivingly engage with the ball, the drive sub being disengageable from the ball to allow the second section to flex relative to the first section to set the second section back against an opposing side of a borehole in which the tool is to be deployed.

2. The tool as claimed in claim 1, wherein the seal anchor includes a rotary ratchet.

3. The tool as claimed in claim 2, wherein the rotary ratchet includes a threaded rod and an expandable nut.

4. The tool as claimed in claim 1, wherein the seal anchor includes a drag block.

5. The tool as claimed in claim 1, wherein the first section comprises a housing having a first part that is movable relative to a second part, the first part exhibiting a first frustoconical surface and the second part exhibiting an oppositely directed second frustoconical surface, the first part and the second part becoming closer to one another upon setting of the seal anchor.

6. The tool as claimed in claim 5, wherein the seal anchor includes a slip cooperative with the first and second frustoconical surfaces.

7. The tool as claimed in claim 1, wherein a segment extends between the first section and the second section.

8. The tool as claimed in claim 7, wherein the segment is separable at a location along a span thereof at a releaser.

9. The tool as claimed in claim 8, wherein the releaser is a pin.

10. The tool as claimed in claim 7, wherein the second section is settable independent of the first section and settable before or after separation of the segment at the releaser.

11. A method for positioning and setting a downhole tool, comprising:

running a tool as claimed in claim 1 to a target location;

setting the seal anchor;

setting the seal packer; and positioning the second section by manipulating the joint.

12. The method as claimed in claim 11, wherein setting the seal anchor comprises rotating the tool while dragging a block of the tool thereby creating relative rotational movement between a first part of a housing of the first section and a second part of the housing of the first section.

13. The method as claimed in claim 12, wherein setting the seal comprises setting down weight on the seal anchor.

14. The method as claimed in claim 13, further comprising activating the joint with the set down weight.

15. The method as claimed in claim 14, further including moving the second section relative to the first section at the joint.

16. The method as claimed in claim 15, wherein the moving includes at least two degrees of freedom.

17. The method as claimed in claim 13, including separating the second section from the first section after setting the seal anchor.

18. A wellbore system comprising:

a borehole in a subsurface formation;

a string in the borehole; and a downhole tool as claimed in claim 1, disposed within or as a part of the string.

* * * * *